US007047626B2

(12) United States Patent
Clulow

(10) Patent No.: US 7,047,626 B2
(45) Date of Patent: May 23, 2006

(54) ENCAPSULATED ELECTRICALLY RESISTIVE HEATER

(75) Inventor: John Clulow, Kane County, IL (US)

(73) Assignee: Bulk Molding Compounds, Inc., West Chicago, IL (US)

( * ) Notice: Subject to any disclaimer, the term of this patent is extended or adjusted under 35 U.S.C. 154(b) by 71 days.

(21) Appl. No.: 10/891,849

(22) Filed: Jul. 15, 2004

(65) Prior Publication Data

US 2006/0011614 A1 Jan. 19, 2006

(51) Int. Cl.
*H05B 3/00* (2006.01)

(52) U.S. Cl. ..... 29/611; 29/610.1; 29/858; 264/250; 264/254; 264/255; 219/544

(58) Field of Classification Search ..... 219/528, 219/544, 548, 549; 29/610.1, 611, 613, 856–858; 264/250, 254, 255, 272.11–272.15, 275
See application file for complete search history.

(56) References Cited

U.S. PATENT DOCUMENTS

| | | | | |
|---|---|---|---|---|
| 4,287,663 | A * | 9/1981 | Newbold, Jr. | 29/611 |
| 4,860,434 | A * | 8/1989 | Louison et al. | 29/611 |
| 4,888,472 | A * | 12/1989 | Stitz | 219/548 |
| 5,008,062 | A * | 4/1991 | Anderson et al. | 264/272.15 |
| 5,714,106 | A * | 2/1998 | Yoda et al. | 264/275 |
| 5,800,763 | A * | 9/1998 | Hoppe et al. | 264/255 |
| 6,036,908 | A * | 3/2000 | Nishida et al. | 264/254 |
| 6,306,331 | B1 * | 10/2001 | Lajza et al. | 264/272.13 |
| 6,434,328 | B1 * | 8/2002 | Rutherford | 392/503 |
| 6,541,744 | B1 * | 4/2003 | Von Arx et al. | 219/544 |
| 6,748,646 | B1 * | 6/2004 | Von Arx et al. | 29/613 |

* cited by examiner

*Primary Examiner*—Robin Evans
*Assistant Examiner*—L Fastovsky
(74) *Attorney, Agent, or Firm*—Jack Schuman

(57) ABSTRACT

Electrically resistive heating element, with metal strip electrodes secured thereto, and with electrical wires secured to said metal strip electrodes, is encapsulated with thermoset-molding compound.

6 Claims, 3 Drawing Sheets

ENCAPSULATED ELECTRICALLY RESISTIVE HEATER

BACKGROUND OF THE INVENTION

1. Field of the Invention

This invention relates, broadly speaking, to a novel method of making a fully encapsulated electrically resistive heater, and to the fully encapsulated electrically resistive heater formed by the said method.

More particularly, this invention relates to a novel method of making an electrically resistive heater fully encapsulated by a thermosetting molding compound comprising a thermosetting polymer, a thermosetting vinyl ester or a thermosetting phenolic.

2. Description of the Prior Art

A prior art search was made to determine the patentability of the present invention, and elicited the following:

U.S. patent Publication No. US 2003/0121140 (Jul. 3, 2003) to Von Arx
U.S. Pat. No. 6,519,835 (2003) to Von Arx
U.S. Pat. No. 6,415,104 (2002) to Fitts
U.S. Pat. No. 6,434,328 (2002) to Rutherford
U.S. Pat. No. 6,337,470 (2002) to Von Arx
U.S. patent Publication No. US 2001/0014212 (Aug. 16, 2001) to Rutherford
U.S. Pat. No. 6,147,335 (2000) to Von Arx
U.S. Pat. No. 5,521,357 (1996) to Lock
U.S. Pat. No. 5,252,944 (1993) to Caddock
U.S. Pat. No. 5,237,155 (1993) to Hill
U.S. Pat. No. 4,197,449 (1980) to Fessenden
U.S. Pat. No. 4,730,103 (1988) to Hawkins
U.S. Pat. No. 3,772,452 (1973) to Usowski None of the prior art mentioned above discloses nor even suggests the present invention.

SUMMARY OF THE INVENTION

One of the objects of the present invention is to provide a novel, efficient and economical method for making a fully encapsulated electrically resistive heater, and the fully encapsulated electrically resistive heater formed by said method.

Another of the objects of the present invention is to provide a novel, efficient and economical method for making an electrically resistive heater incorporating a thermosetting molding compound to fully encapsulate the electrically resistive heater, and also the electrically resistive heater formed by said method.

Still other and further objects of the present invention will become apparent by reference to the specification and drawings and to the appended claims.

Briefly, the foregoing objects are attained by molding a thermosetting molding compound around one face and the sides of an electrically resistive heating element in a mold, reversing in the mold the electrically resistive heating element, securing in electrical contact with said heating element metal strip electrodes and wires on the other face of said electrically resistive heating element, molding a similar thermosetting molding compound around the said other face in contact with the previously applied thermosetting molding compound around the sides of the electrically resistive heating element, removing said fully encapsulated electrically resistive heater from said mold, and removing some of said thermosetting molding compound around the said wires to permit an electrical connection to be made between said wires and a source of current.

DESCRIPTION OF THE DRAWINGS

Referring now to the drawings, in which like numerals represent like parts in the several views.

DESCRIPTION OF THE PREFERRED EMBODIMENT

Electrically resistive heating element 1, the dimensions of which have been determined to produce with the power source available (e.g., 120 volts typically available to households) the desired wattage and thus the desired heat output, is centrally positioned in cavity 2 of mold 3.

Figure 1:
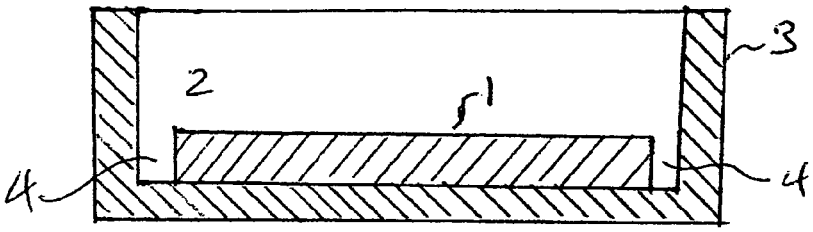
FIG. 1 shows, in vertical section, an electrically resistive heating element positioned in a mold.
Figure 2:
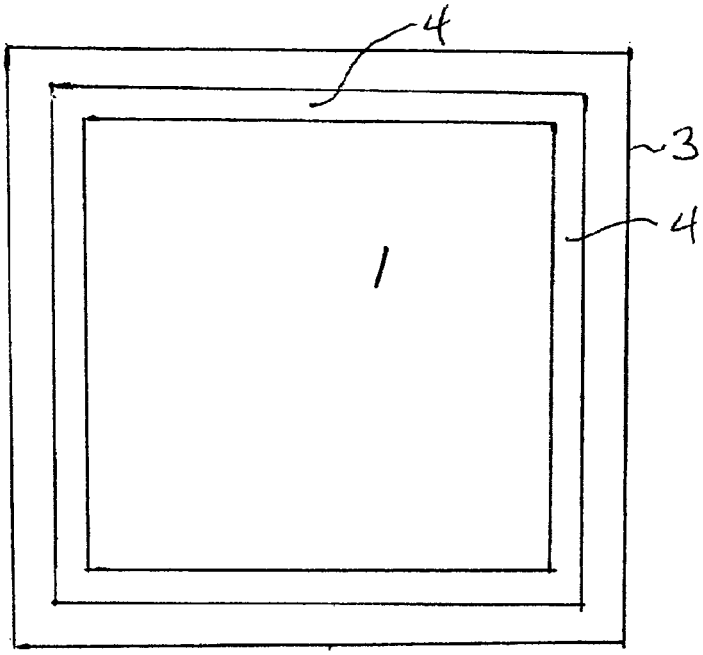
FIG. 2 shows a view in plan of the electrically resistive heating element centrally positioned in the mold.

The dimensions of cavity 2 are so chosen that with the heating element 1 centrally positioned therein, a space 4, as shown in FIG. 2, is maintained along all sides of heating element 1 which may, for example, be a panel 11 inches square.

Electrically resistive heating element 1 is heated in mold 3 prior to application of a thermosetting molding compound 5 which may, for example, comprise thermosetting polyester, a thermosetting vinyl ester, or a thermosetting phenolic.

Figure 3:
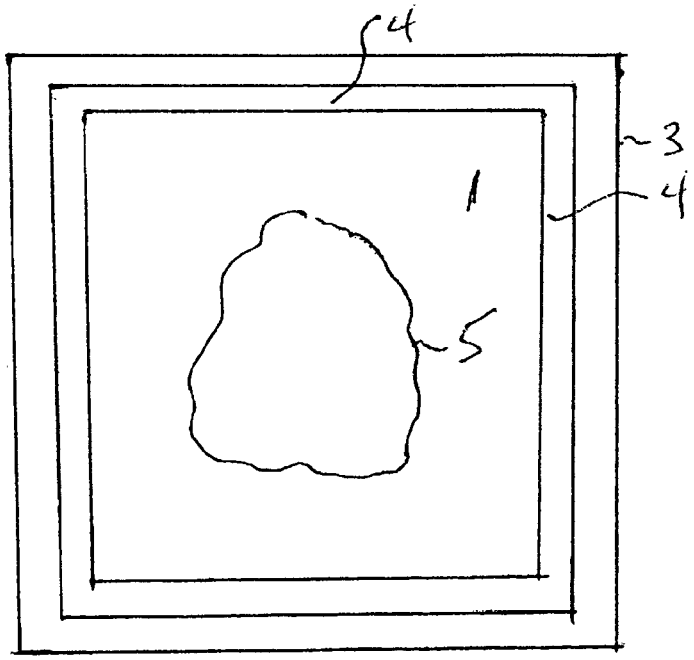
FIG. 3 shows a view in plan of the electrically resistive heating element positioned in the mold, with a quantity of thermosetting molding compound applied to one face of the said electrically resistive heating element.

A quantity of the thermosetting molding compound 5 is applied to one face of the electrically resistive heating element 1, as shown in FIG. 3.

Figure 4:
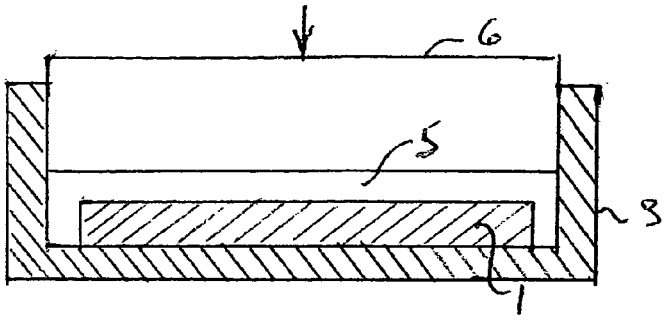
FIG. 4 shows, in vertical section, a press proceeding downwardly in the mold against the thermosetting molding compound to force said thermosetting molding compound against the face and around the sides of the electrically resistive heating element.

Press 6, closing mold 3, is forced downwardly in mold 3 against thermosetting molding compound 5, as shown in FIG. 4, forcing the said thermosetting molding compound 5 against the face of the electrically resistive heating element 1 and into space 4 along all sides of the said electrically resistive heating element 1.

Figure 5:
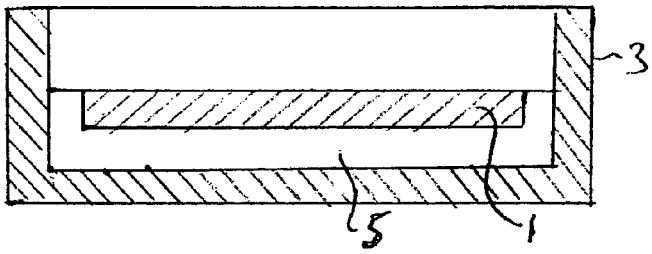
FIG. 5 shows a vertical section of the mold, with the electrically resistive heating element and the thermosetting molding compound on the one face thereof reversed in the mold.

After the thermosetting molding compound 5 has fully cross-linked, electrically resistive heating element 1, with the said cross-linked thermosetting molding compound 5 adhering to the said one face thereof and adhering to said electrically resistive heating element 1 along all sides thereof, is removed from mold 3, after press 6 has been extracted therefrom, reversed and reinserted into cavity 2, with the previously applied thermosetting molding compound 5 at the bottom of cavity 2, as shown in FIG. 5.

Figure 6:
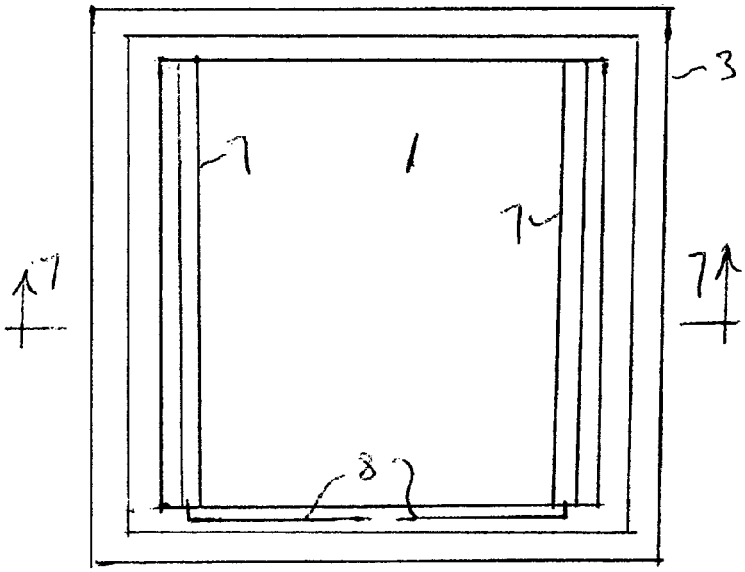
FIG. 6 shows a view in plan of that face of said electrically resistive heating element not yet encapsulated by the thermosetting molding compound, in said mold, with metal strip electrodes and connecting wires secured to said face.

Metal strip electrodes 7 are secured in electrical contact with heating element 1 as shown in FIG. 6. Such securement may, for example, be accomplished by using a conductive adhesive manufactured by Bulk Molding Compounds, Inc. of West Chicago, Ill. These metal strip electrodes 7 may be affixed to electrically resistive heating element 1 when the said electrically resistive heating element 1 has been removed from mold 3, or may be affixed to electrically resistive heating element 1 when the latter is in the said mold 3.

Electrical wires 8 are secured to the ends of the said metal strip electrodes 7, as shown in FIG. 6.

Figure 7:
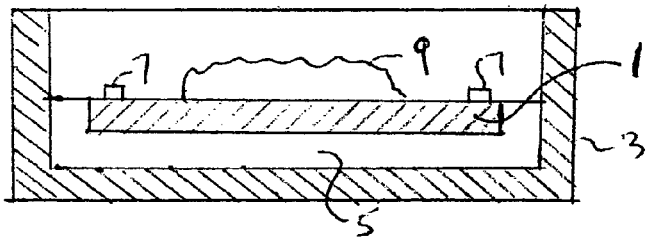
FIG. 7 shows a section taken along the line 7—7 of FIG. 6, the metal strip electrodes secured in electrical contact to the as yet unencapsulated face of the electrically resistive heating element, and a quantity of thermosetting molding compound applied to the said face of the electrically resistive heating element.

Another quantity of thermosetting molding compound 9 is applied to the other face of electrically resistive heating element 1, as shown in FIG. 7.

Figure 8:
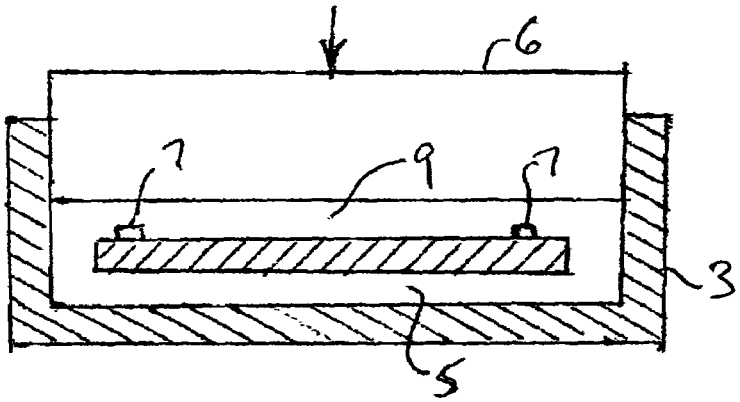
FIG. 8 shows a press proceeding downwardly in the mold against the thermosetting molding compound shown in FIG. 7 to force said thermosetting molding compound against the face of the electrically resistive heating element and in contact with the previously molded thermosetting molding compound of FIG. 5 around the sides of the said electrically resistive heating element, thereby fully encapsulating the said electrically resistive heating element.

Press 6, again closing mold 3, as shown in FIG. 8, is forced downwardly in mold 3, thereby forcing the said thermosetting molding compound 9 against the other face of electrically resistive heating element 1 and also into adhering contact with the previously molded thermosetting molding compound 5 in space 4.

At this point, it will be noted that portions of thermosetting molding compounds in general, and specifically such thermosetting molding compounds comprising thermosetting polyesters, thermosetting vinyl esters, or thermosetting phenolics, have the capacity to securely adhere to each other in the molding process.

Figure 9:
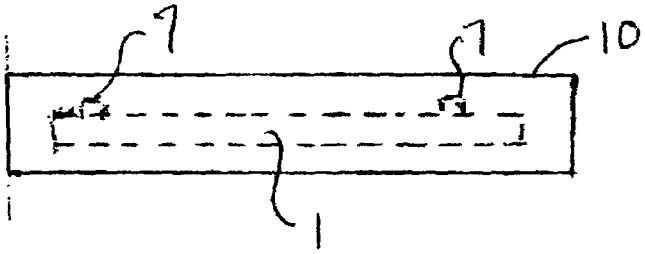
FIG. 9 shows the fully encapsulated electrically resistive heater removed from the mold and ready for use.

After thermosetting molding compound 9 has fully crosslinked and press 6 has been extracted from mold 3 thus to open the said mold 3, electrically resistive heater 10, now fully encapsulated by the thermoset molding compounds 5 and 9, is removed from mold 3, and is shown in FIG. 9. A small portion of the thermoset encapsulation surrounding the ends of wires 8 may be ground away so as to expose the said ends of wires 8, thereby permitting contact of said wires 8 with other wires leading to a source of electric power.

The fully encapsulated electrically resistive heater 10 is now ready for use.

Since modifications and changes which do not depart from the spirit of the invention as disclosed herein may readily occur to those skilled in the art to which this invention pertains, the appended claims should br construed as covering all suitable modifications and equivalents.

I claim:

1. Method of making an encapsulated electrically resistive heater, said method comprising:

(a) providing a mold having a cavity therein, (b) centrally positioning an electrically resistive heating element in said cavity, (c) said cavity having a length and width greater than the length and width of said electrically resistive heating element, thereby to provide a space between said cavity and said electrically resistive heating element, said space extending completely around the sides of said electrically resistive heating element (d) said electrically resistive heating element having a first face and a second face opposite said first face, (e) said second face contacting the bottom of said cavity, (f) applying a first thermosetting molding compound to said first face of said electrically resistive heating element, (g) forcing a press into said mold against said first thermosetting molding compound, thereby to force said first thermosetting molding compound against the first face of said electrically resistive heating element and into said space, (h) allowing said first thermosetting molding compound to cross-link, (i) removing said electrically resistive heating element from said mold, reversing said electrically resistive heating element and reinserting said electrically resistive heating element into said cavity, said first thermosetting molding compound contacting the bottom of said cavity, (j) securing electrodes to said second face of said electrically resistive heating element, (k) applying a second thermosetting molding compound to said second face of said electrically resistive heating element, (l) forcing a press into said mold against said second thermosetting molding compound thereby to force said second thermosetting molding compound against the second face of said electrically resistive heating element and into contact with said first thermosetting molding compound in said space, (m) allowing said second thermosetting molding compound to cross-link, (n) removing the now-formed encapsulated electrically resistive heating element from said mold, (o) removing a portion of said encapsulation from around the ends of said electrodes to permit connection to a source of electricity.

2. Method as in claim 1, wherein step (j) may be performed when said electrically resistive heating element is in said mold.

3. Method as in claim 1, wherein step (j) may be performed before said electrically resistive heating element is reinserted into said mold.

4. Method as in claim 1, wherein:

(p) said electrodes comprise metal strips secured to said electrically resistive heating element, and wires connected to said metal strips, (q) a portion of said encapsulation is removed from around the ends of said wires.

5. Method as in claim 1, wherein:

(p) said electrodes are secured to said electrically resistive heating element adjacent opposite sides of the said electrically resistive heating element.

6. Method as in claim 1, wherein said electrically resistive heating element is heated in said mold prior to application of said first thermosetting molding compound to a temperature that will facilitate molding and cross-linking said first and second thermosetting molding compounds.

* * * * *